US010338503B2

(12) United States Patent
Maeda et al.

(10) Patent No.: US 10,338,503 B2
(45) Date of Patent: Jul. 2, 2019

(54) FIXING DEVICE INCLUDING ROTARY MEMBER TO SUPPRESS VAPORIZED COMPONENT ESCAPE

(71) Applicant: CANON KABUSHIKI KAISHA, Tokyo (JP)

(72) Inventors: Masafumi Maeda, Yokohama (JP); Masaki Tanaka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/150,941

(22) Filed: May 10, 2016

(65) Prior Publication Data

US 2016/0349683 A1 Dec. 1, 2016

(30) Foreign Application Priority Data

May 27, 2015 (JP) ..... 2015-107880

(51) Int. Cl.
*G03G 15/20* (2006.01)
*G03G 21/20* (2006.01)

(52) U.S. Cl.
CPC ..... *G03G 15/2017* (2013.01); *G03G 21/206* (2013.01)

(58) Field of Classification Search
CPC ..... G03G 15/2017; G03G 21/206
See application file for complete search history.

(56) References Cited

U.S. PATENT DOCUMENTS

2011/0243598 A1 10/2011 Suzuki
2013/0251390 A1* 9/2013 Ishii ..... G03G 15/205 399/67
2014/0086616 A1* 3/2014 Nojima ..... G03G 15/2017 399/98
2014/0086617 A1* 3/2014 Nojima ..... G03G 15/2025 399/98
2014/0140720 A1* 5/2014 Matsumoto ..... G03G 15/2025 399/98
2014/0178091 A1* 6/2014 Sugiyama ..... G03G 15/2017 399/92
2015/0268605 A1* 9/2015 Nojima ..... G03G 15/2053 399/330

FOREIGN PATENT DOCUMENTS

| | | | |
|---|---|---|---|
| CN | 103676578 A | | 3/2014 |
| CN | 104317178 A | | 1/2015 |
| JP | 55088919 A | * | 7/1980 |
| JP | 2008-268469 A | | 11/2008 |
| JP | 2008-275963 A | | 11/2008 |
| JP | 2010249874 A | | 11/2010 |
| JP | 2011237555 A | | 11/2011 |
| JP | 2012-008206 A | | 1/2012 |
| JP | 2014-077988 A | | 5/2014 |
| JP | 2014-077989 A | | 5/2014 |
| JP | 2014123111 A | | 7/2014 |
| JP | 2014-142606 A | | 8/2014 |

* cited by examiner

*Primary Examiner* — Walter L Lindsay, Jr.
*Assistant Examiner* — Arlene Heredia
(74) *Attorney, Agent, or Firm* — Canon U.S.A., Inc. IP Division

(57) ABSTRACT

A fixing apparatus including a rotary member in which a generatrix direction thereof is substantially parallel to a generatrix direction of a film, the rotary member being provided between the film and a cover member such that a gap is formed between the film and the rotary member.

20 Claims, 8 Drawing Sheets

FIXING DEVICE INCLUDING ROTARY MEMBER TO SUPPRESS VAPORIZED COMPONENT ESCAPE

BACKGROUND OF THE INVENTION

Field of the Invention

The present disclosure relates to a fixing apparatus that fixes a toner image formed on a recording material using an electrophotographic recording technology by melting the toner image with heat.

Description of the Related Art

Image forming devices such as copiers and printers that use electrophotographic recording technology are equipped with a fixing apparatus that fixes a toner image formed on a recording material to the recording material by melting the toner image with heat. In recent years, many electrophotographic toner includes release wax as the constituent material thereof. The wax is added to adjust the gloss of the image and the dispersibility of the pigment, and to prevent the toner from being offset.

It is known that release wax vaporizes when heated. When the vaporized component adheres to a conveyance guide in the image forming apparatus, it becomes a conveyance resistance, and when adhered to a conveyance roller, it becomes a cause of decrease in friction coefficient of the roller lowering the conveyance performance, leading to problems such as sheet jamming and the like.

Japanese Patent Laid-Open No. 2010-249874 discloses a technique of suppressing the amount of vaporized component going out of a fixing apparatus.

SUMMARY OF THE INVENTION

The present invention provides another technology of suppressing the amount of vaporized component going out of a fixing apparatus.

The present disclosure provides a fixing apparatus that fixes an unfixed toner image formed on a recording material to the recording material, the fixing apparatus including: a rotatable film; a pressure member that forms a fixing nip portion that pinches and conveys the recording material by being in contact with the film; and a cover member that surrounds the film, in which the unfixed toner image formed on the recording material is fixed to the recording material at the fixing nip portion with heat from the film, and in which the fixing apparatus further includes a rotary member in which a generatrix direction thereof is substantially parallel to a generatrix direction of the film, the rotary member being provided between the film and the cover member such that a gap is formed between the film and the rotary member.

The present disclosure provides a fixing apparatus that fixes an unfixed toner image formed on a recording material to the recording material, the fixing apparatus including: a fixing roller; a rotatable heat member that is in contact with a surface of the fixing roller; a pressure member that forms a fixing nip portion that pinches and conveys the recording material by being in contact with the fixing roller; and a cover member that surrounds the fixing roller and the heat member, in which the unfixed toner image formed on the recording material is fixed to the recording material at the fixing nip portion with heat from the heat member, and in which the fixing apparatus further includes a rotary member in which a generatrix direction thereof is substantially parallel to a generatrix direction of the heat member, the rotary member being provided between the heat member and the cover member such that a gap is formed between the heat member and the rotary member.

Further features of the present invention will become apparent from the following description of exemplary embodiments with reference to the attached drawings.

DESCRIPTION OF THE EMBODIMENTS

First Exemplary Embodiment

Figure 1:
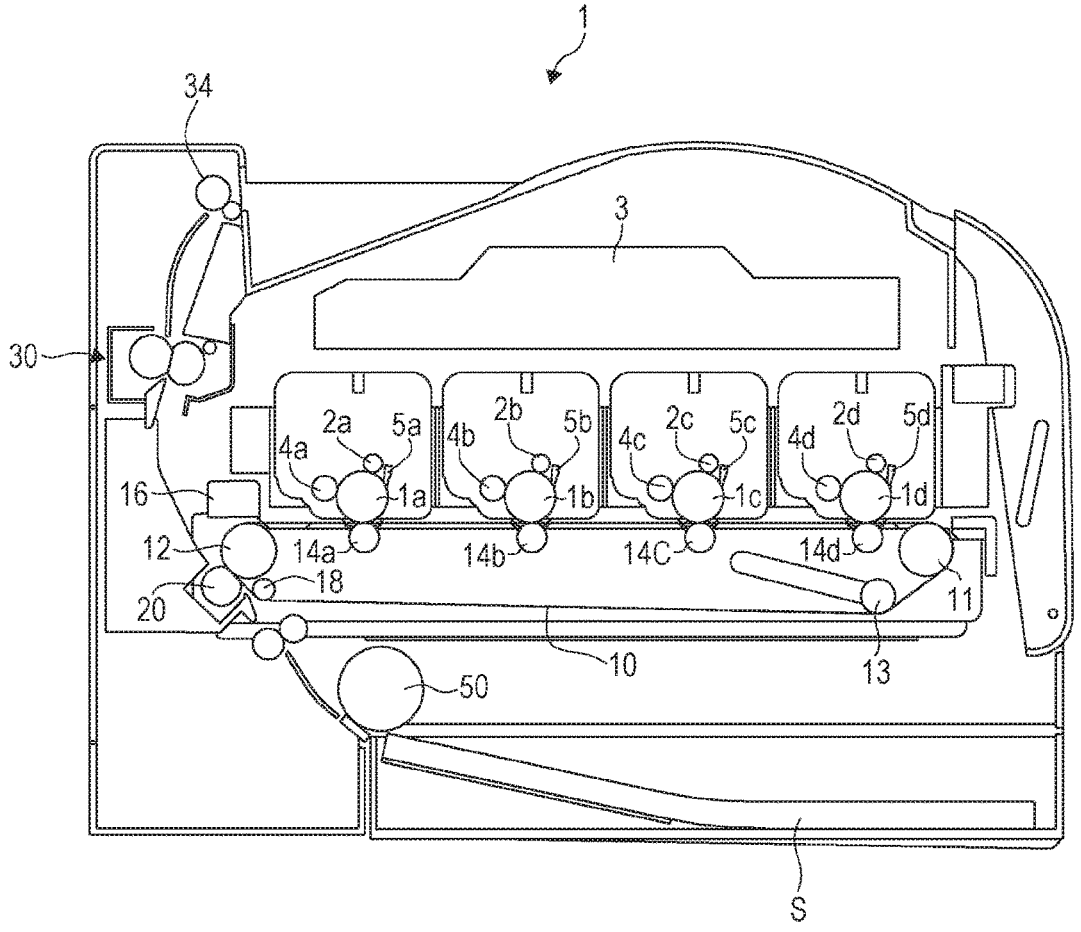
FIG. 1 is a cross-sectional view for describing an image forming apparatus.

FIG. 1 is a cross-sectional view of an image forming apparatus 1 in which fixing apparatuses of first to fourth exemplary embodiments are installed. The image forming apparatus 1 is a color image forming apparatus adopting an intermediate transfer belt system. Referring to FIG. 1, the configuration of the image forming apparatus 1 will be described.

The image forming apparatus 1 includes drum-shaped electrophotographic photoconductors (hereinafter, referred to as photosensitive drums) 1*a*, 1*b*, 1*c*, and 1*d*, and the photosensitive drums 1*a*, 1*b*, 1*c*, and 1*d* are rotationally driven at a predetermined circumferential velocity (a process speed). In the course of rotation, the photosensitive drums 1*a*, 1*b*, 1*c*, and 1*d* are charged to a predetermined polarity and potential in a uniform manner by the charge rollers 2*a*, 2*b*, 2*c*, and 2*d* and, subsequently, image exposure is performed thereon by an image exposing member 3. With the above, an electrostatic latent image corresponding to image information is formed on each of the photosensitive drums 1*a*, 1*b*, 1*c*, and 1*d*. Subsequently, the electrostatic latent images are developed by the developing units 4*a*, 4*b*, 4*c*, and 4*d* of each color at developing positions and are visualized as toner images.

An intermediate transfer belt 10 is an endless belt and is stretched by stretching members (a driving roller 11, a facing roller 12, a tension roller 13, and an auxiliary roller 18). The belt 10 is rotationally driven at a circumferential velocity that is substantially the same as that of the photosensitive drums 1*a*, 1*b*, 1*c*, and 1*d*. In the course of passing through abutment portions (hereinafter, referred to as primary transfer nips) between the photosensitive drums 1*a*, 1*b*, 1*c*, and 1*d* and the intermediate transfer belt 10, the toner images formed on the photosensitive drums 1*a*, 1*b*, 1*c*, and 1*d* are transferred (primary transferred) onto the intermediate transfer belt 10. Reference numerals 14*a*, 14*b*, 14*c*, and 14*d* are primary transfer rollers to which a voltage for performing primary transfer is applied. Residual toner on the surfaces of the photosensitive drums 1*a*, 1*b*, 1*c*, and 1*d* that has not been transferred with the primary transfer voltage is cleaned off and removed by cleaning devices 5*a*, 5*b*, 5*c*, and 5*d*.

In the course of passing through a secondary transfer nip between the intermediate transfer belt 10 a secondary transfer roller 20, the four color toner images that have been superimposed on the intermediate transfer belt 10 are transferred at a time on a surface of a sheet (a recording material) S said by the sheet feeding member 50. Reference numeral 20 is the secondary transfer roller to which a voltage for performing secondary transfer is applied. Subsequently, the sheet S carrying the four color toner images is guided into a fixing apparatus 30, and the four colors of toner being heated and compressed in the fixing apparatus 30 are melted and mixed and are fixed to the sheet S. With the above operation, a full-color image is formed on the sheet S and, subsequently, the sheet S is discharged outside the machine by a discharge roller 34.

Furthermore, toner residing on the surface of the intermediate transfer belt 10 is cleaned of and removed by a transfer belt cleaning device 16.

Figure 2:
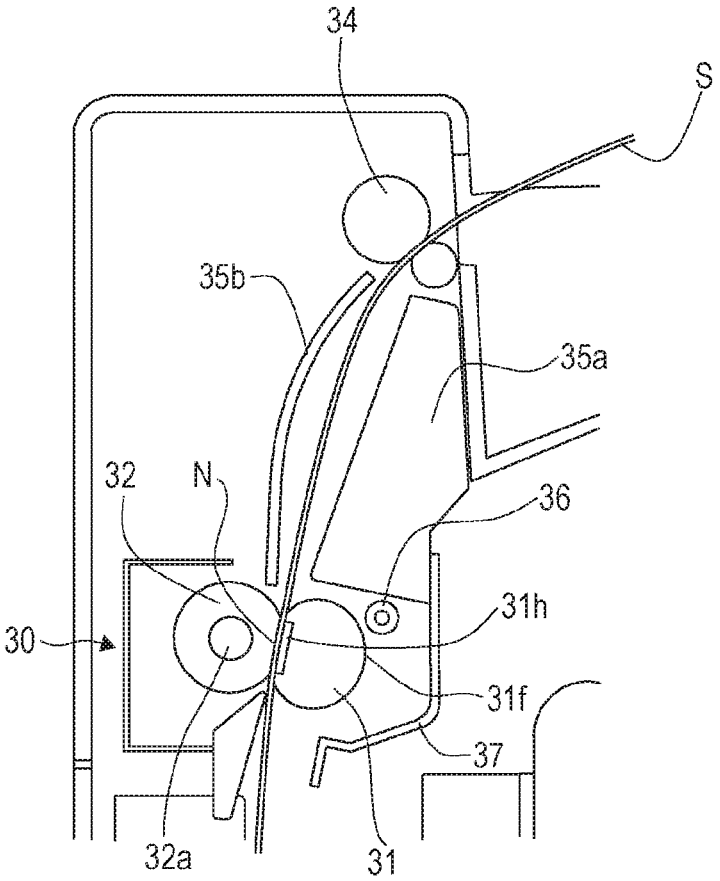
FIG. 2 is a schematic diagram of a fixing apparatus and portions therearound.
Figure 3A:
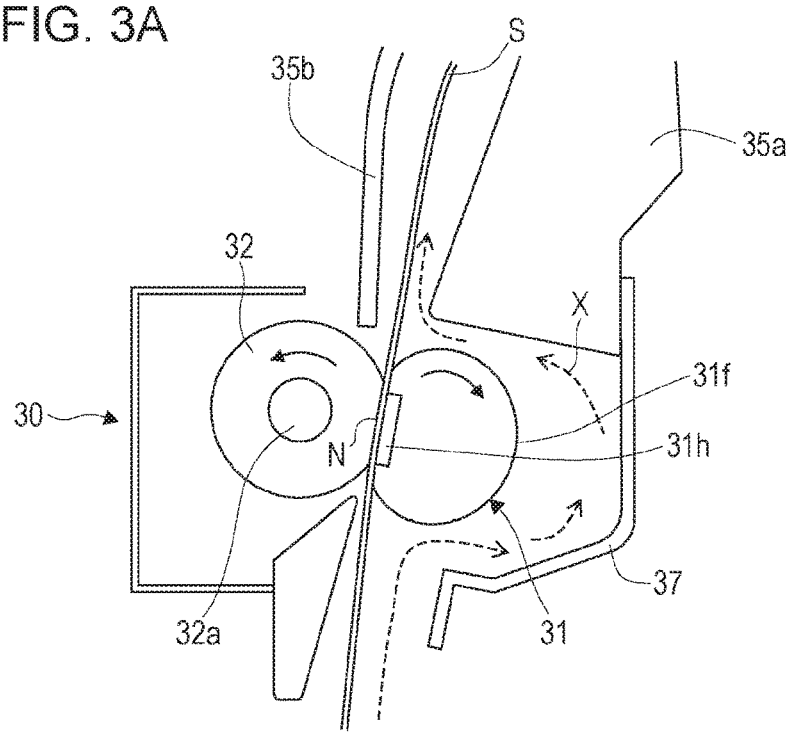
FIG. 3A illustrates an airflow inside a fixing apparatus of a comparative example.
Figure 3B:
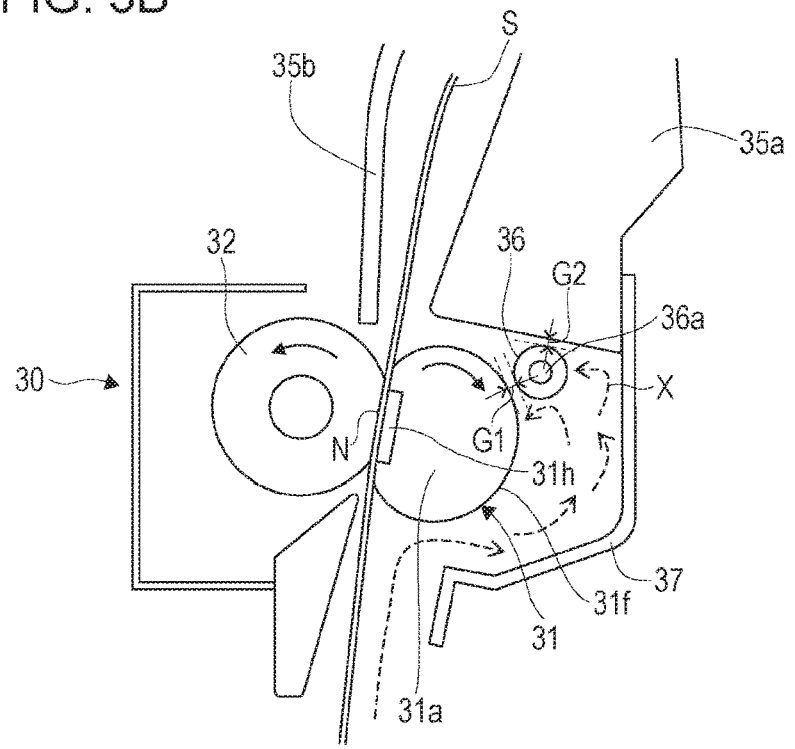
FIG. 3B illustrates an airflow inside a fixing apparatus of a first exemplary embodiment.

Referring to FIGS. 2, 3A, and 3B, a generating state of a vaporized component of wax inside the fixing apparatus will be described next. A heating member 31 for heating the sheet S on which the toner images have been transferred includes a heat resistant film (a heat member) 31*f*, and a heater 31*h* provided inside the heat member 31*f*. A fixing nip portion N that pinches and conveys the sheet S between the heating member 31 and a pressure roller (a pressure member) 32 that is provided so as to be rotatable about a rotating shaft 32*a* is formed. The fixing process of the sheet S is performed in the fixing nip portion N. The sheet S on which the fixing process has been performed is guided by guide members 35*a* and 35*b* and is discharged outside the device by the discharge roller 34. As described above, the fixing apparatus of the present exemplary embodiment includes a rotatable heat member 31*f*, and a pressure member 32 that forms the fixing nip portion N by coming in contact with the heat member 31*f*. While pinching and conveying, with the fixing nip portion N, the recording material carrying the unfixed toner image, heat from the heat member 31*f* fixes the unfixed toner image to the recording material.

When the wax alone in the toner used in the image forming apparatus of the present exemplary embodiment is heated, the vaporized component is generated at around 150° C. Accordingly, in the image forming apparatus, the source of the vaporized component is considered to be members onto which the wax adheres and which become 150° C. or more. Members onto which the wax adheres and which become high in temperature are the sheet S, the film 31*f*, and the surface of the pressure roller 32. Under the condition of the present exemplary embodiment, since the sheet S takes the heat of the pressure roller 32, the member that becomes 150° C. or more is the film 31*f*. Accordingly, the dominant source of the vaporized component is considered to be the surface of the film 31*f*. Accordingly, it is important to keep the vaporized component generated from the surface of the film 31*f* inside the fixing apparatus 30.

Influenced by the airflow, the vaporized component is discharged outside the fixing apparatus. Referring to FIGS. 3A and 3B, the airflow in the vicinity of the film 31*f* will be described. FIG. 3A illustrates an airflow inside a fixing apparatus of a comparative example, and FIG. 3B illustrates an airflow inside the fixing apparatus of the present exemplary embodiment.

As illustrated in FIG. 3A, the heating member 31 is surrounded by a cover member 37 and the guide member 35*a*. Note that similar to the cover member 37, the guide member 35*a* serves to surround the heat member 31*f*. The same applies to the present exemplary embodiment illustrated in FIG. 3B. As illustrated in FIG. 3A, since an upward current X is generated inside the fixing apparatus with the heat of the airflow stagnating inside the image forming apparatus and the fixing apparatus, the vaporized component generated on the surface of the film 31*f* is disadvantageously discharged outside the fixing apparatus. In order to not have the vapor component be discharged outside the fixing apparatus, the gaps between the guide member 35*a* and the cover member 37, and the film 31*f* may be narrowed. In order to make the gaps narrow, a member that narrows the gaps may be provided; however, when the member is disposed close to the film 31*f* close enough to obtain the advantage of suppressing the discharge of the vaporized component, due to, for example, the tolerance of the member and deformation of the member caused by heat, an adverse effect such as the member coming in contact with the film 31*f* occurs. When a gap that is large enough to prevent the adverse effect from occurring is provided, the advantage of suppressing the discharge becomes small.

Accordingly, the present exemplary embodiment includes a rotary member 36 in which the generatrix direction of the rotary member 36 is substantially parallel to the generatrix direction of the heat member 31*f*. The rotary member 36 is provided between the heat member 31*f* and the cover member 35*a* with a gap between the heat member 31*f*. Specifically, as illustrated in FIG. 3B, a gap filling member (the rotary member) 36 that is supported by a shaft 36*a* and that has a cylindrical shape is disposed between the film 31*f* and the guide member 35*a* that also serves as the cover member. With the above, the airflow to the outside of the fixing apparatus can be suppressed. By using a metal shaft, the shaft 36*a* supporting the gap filling member 36 can maintain its accuracy and strength and can avert the effect caused by heat and deformation. Furthermore, the material of the gap filling member 36 is liquid crystal polymer. A gap G1 between the rotary member 36 and the film 31*f* is preferably in the range of 0.5 mm to 2.0 mm and a gap G2 between the rotary member 36 and the guide member 35*a* serving as the cover member is preferably in the range of 0.5 mm to 2.0 mm. In the present exemplary embodiment, G1=1.5 mm, G2=0.5 mm.

Figure 4A:
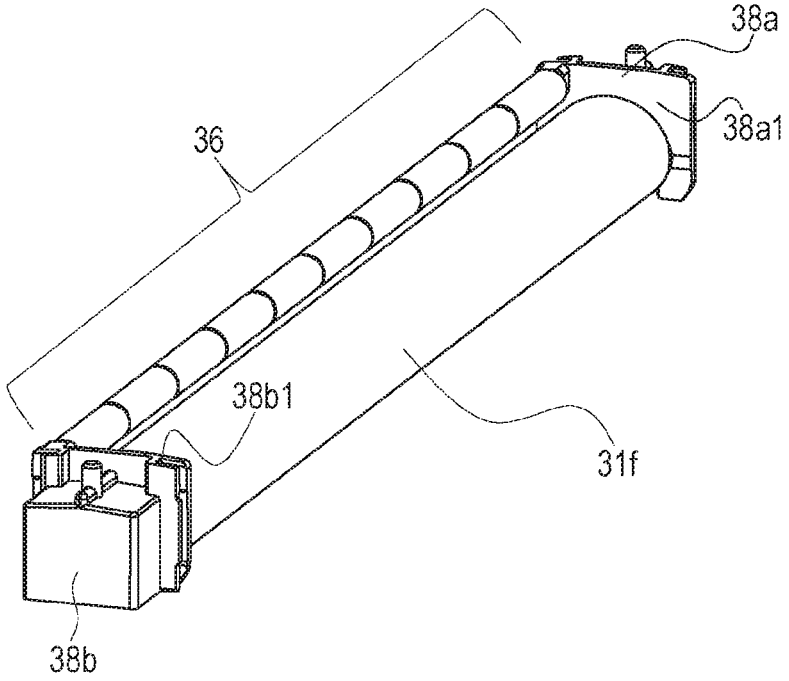
FIGS. 4A and 4B are diagrams illustrating a holding structure of a gap filling member of the first exemplary embodiment.
Figure 4B:
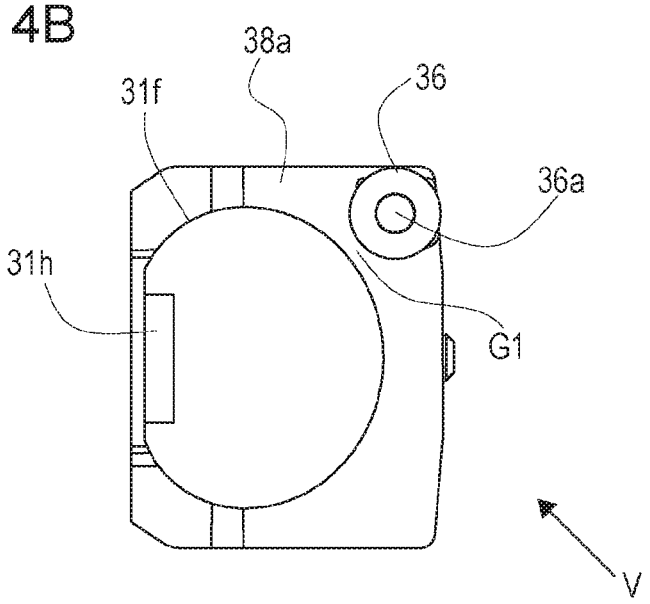

A configuration of the gap filling member 36 will be described next with FIGS. 4A and 4B. The gap G1 is set between the gap filling member 36 and the film 31*f* so that the gap filling member 36 comes in contact with the film 31*f* as least as possible during the fixing process. The gap filling member 36 is rotatably supported by the shaft 36*a*. Furthermore, the gap filling member 36 has a cylindrical shape and is rotatable. Accordingly, for example, when the film 31*f* comes into contact with the gap filling member 36 during transportation of the image forming apparatus, and when the film 31*f* comes into contact with the gap filling member 36 due to jitter of the film 31*f*, damage to the film 31*f* can be suppressed. Furthermore, the shaft 36*a* that supports the gap filling member 36 is attached to restriction members 38*a* and 38*b* that includes surfaces 38*al* and 38*b*1 that face the end face of the film 31*f* and that restricts movement of the film 31*f* in the generatrix direction. With the above, the positional accuracy of the gap filling member 36 with respect to the film 31*f* improves and, accordingly, the gap G1 can be made small to the extent possible. Furthermore, in the exemplary embodiment, as illustrated in FIG. 4A, the gap filling member 36 is divided into a plurality of pieces (10 pieces in the present exemplary embodiment, as illustrated in FIG. 4A) in the generatrix direction of the film 31*f*; accordingly, even if the component should deform, the effect of the deformation on the gap G1 can be made small.

The above configuration can suppress air from flowing from the inside of the fixing apparatus to the outside of the fixing apparatus and suppress the vaporized component generated from the film 31*f* from being discharged outside the fixing apparatus. The vaporized component that has been restricted from being discharged outside of the fixing apparatus and that stagnates in the space inside the fixing apparatus becomes cohered to each other or becomes captured by the surface of the guide member 35*a* or the cover member 37. Accordingly, the amount of vaporized component discharged outside the fixing apparatus can be suppressed and adhesion of the vaporized component to the conveyance guide and the like can be suppressed. Furthermore, a filter and the like for capturing the vaporized component can be dispensed with.

Second Exemplary Embodiment

Description of a second exemplary embodiment will be given next. Note that since the basic configuration of the present exemplary embodiment is the same as that of the first exemplary embodiment, redundant description will be omitted and a configuration that is a feature of the present exemplary embodiment will be described herein. Furthermore, members having the same function as that of the members of the exemplary embodiment described above will be attached with the same reference numerals and description thereof will be omitted.

Figure 5:
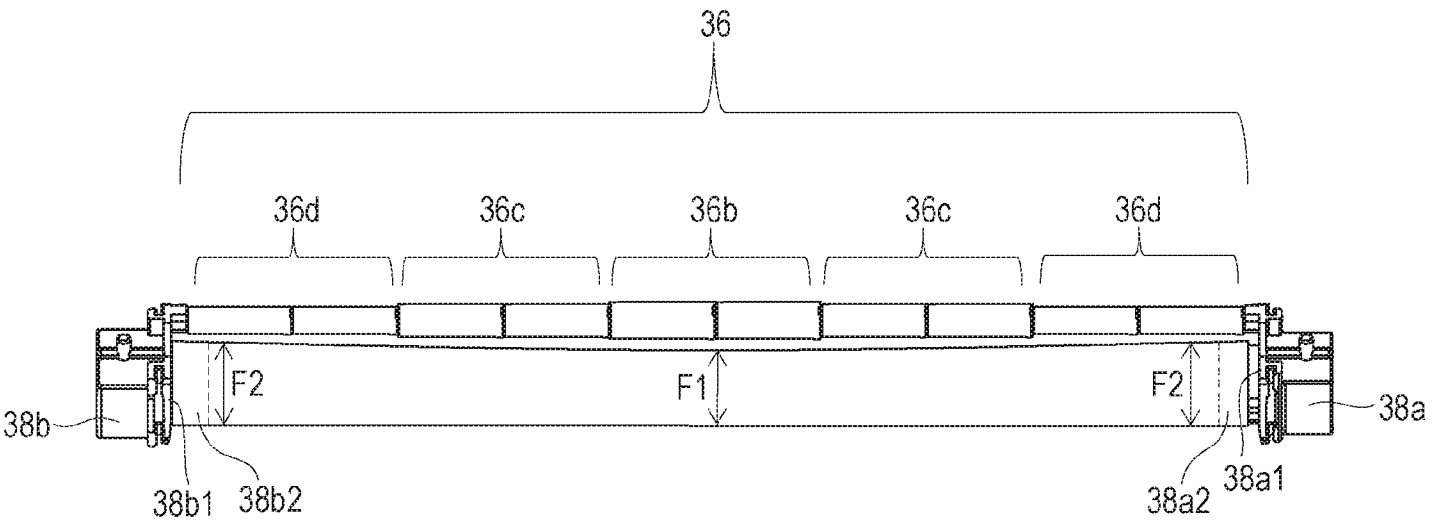
FIG. 5 is a schematic diagram for describing a gap filling member of a second exemplary embodiment.

FIG. 5 is a schematic drawing of a second exemplary embodiment. Since the heating member 31 is in pressure contact with the pressure roller 32, the film 31*f* rotates in an oval shape. Since the two edges of the film 31*f* are held by the holding members 38*a* and 38*b* that include guide portions 38*a*2 and 38*b*2 that faces the inner surface of the two edges of the film 31*f* and that guides the film 31*f*, the cross-sectional shapes of the film 31*f* at the edge portions and at the middle portion of the film 31*f* in the generatrix direction are different. FIG. 5 is a figure of the heating member 31 of the second exemplary embodiment viewed in a V direction illustrated in FIG. 4B and, as illustrated in FIG. 5, when viewed in the V direction, the film 31*f* is shaped such that the middle of the film 31*f* has a diameter F1 and the two edge portions thereof have a diameter F2 (>F1). Accordingly, as illustrated in FIG. 5, the divided gap filling members (36*b*, 36*c*, and 36*d*) are supported by the shaft 36*a* while having different diameters. With the above, even if the cross-sectional shapes of the film 31*f* are different in the generatrix direction, that gap G1 between the film 31*f* and the gap filling member 36 in the generatrix direction can be almost uniform. In the present exemplary embodiment, the diameter of gap filling members 36*b*>diameter of gap filling members 36*c*>the diameter of gap filling member 36*d* holds true, in other words, the diameters of the gap filling members are reduced towards the edge portion from the middle. Note that since the two edges of the film 31*f* are guided by the guide portions 38*a*2 and 38*b*2, the rotation trajectories at the two edges of the film 31*f* are relatively stable. Conversely, since the middle portion of the film 31*f* is not guided by the guide portions 38*a*2 and 38*b*2, compared with the two edges, the rotation trajectory is not stable. Accordingly, the gap G1 at the middle may be set larger than those at the edge portions.

Third Exemplary Embodiment

Figure 6:
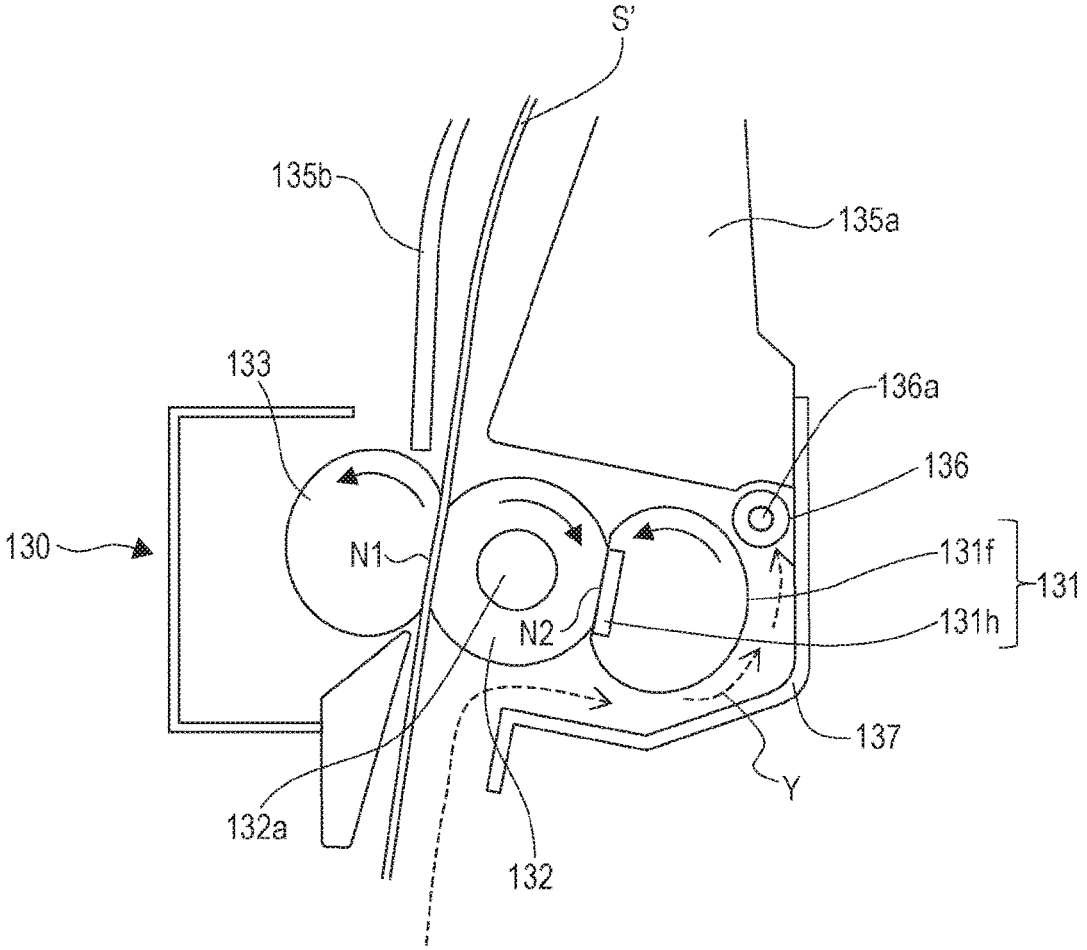
FIG. 6 is a cross-sectional view of a fixing apparatus of a third exemplary embodiment.

Referring to FIG. 6, description of a third exemplary embodiment will be given next. Different from the fixing system of the first and second exemplary embodiment, the fixing apparatus 130 of the present exemplary embodiment adopts an external heating system in which a heating nip portion and a compressing nip portion are separate. The fixing apparatus of the external heating system is capable of being in pressure contact with the toner image surface with a rubber roller (corresponding to a fixing roller described later); accordingly, a relatively inexpensive heat resistant film can be used as the heat resistant film forming the heating nip portion. Furthermore, the heating nip portion may be a heating nip portion with no heat resistant film.

The fixing apparatus 130 is provided with a fixing roller 132 that is a fixing member for heating a sheet S' on which toner images have been transferred and that is rotatable about a rotating shaft 132*a*. Furthermore, a first nip portion (a fixing nip portion) N1 is formed with the fixing roller 132 and a pressure member 133 being in pressure contact with each other, and the sheet S' is pinched and conveyed with the nip portion N1. Furthermore, a heating member 131 is in pressure contact with the fixing roller 132, and a second nip portion (a heating nip portion) N2 is formed between the fixing roller 132 and the heating member 131. A heater 131*h* is provided inside the heating member 131. By driving the fixing roller 132 in a direction of the arrow in FIG. 6, a cylindrical heat resistant film 131*f* rotates around the heater 131*h*. The second nip portion N2 is formed between the heater 131*h* and the fixing roller 132 with the film 131*f* in between, and heat is transferred from the heating member 131 to the fixing roller 132 at the second nip portion N2. The fixing roller 132 to which heat has been supplied heats the sheet S' that is pinched and conveyed at the first nip portion N1. With the above, the unfixed toner images on the sheet S' are fixed to the sheet S'. The sheet S' after the fixing process is guided by guide members 135*a* and 135*b* and is discharged outside the device by a discharge roller (not shown). As described above, the fixing apparatus 130 includes a fixing roller 132, the rotatable heat member 131*f* that is in contact with the surface of the fixing roller 132, and the pressure member 133 that forms the fixing nip portion N1 by contacting the fixing roller 132. Furthermore, while the recording material carrying an unfixed toner image is pinched and conveyed at the fixing nip portion N1, the unfixed toner image is fixed to the recording material with the heat from the heat member 131*f*.

As illustrated in FIG. 6, by disposing the cylindrical shaped gap filling member 136, which is supported by the shaft 136*a*, in the vicinity of the film 131*f*, the guide member 135*a*, and the cover member 137, a flow of an upward current Y can be suppressed. The guide member (the cover member) 135*a* and the cover member 137 surround the fixing roller 132 and the heat member 131*f*. With the above, the amount of vaporized component discharged outside the fixing apparatus can be suppressed and adhesion of the vaporized component to the conveyance surfaces of the guide members 135*a* and 135*b* can be suppressed. Note that the size of the gap between the film 131*f* and the gap filling member 136 and the size of the gap between the guide member 135*a* and the gap filling member 136 are the same as those of the first exemplary embodiment. The preferable ranges of the gaps are the same as the first exemplary embodiment and are each 0.5 mm to 2.0 mm.

Fourth Exemplary Embodiment

Figure 7:
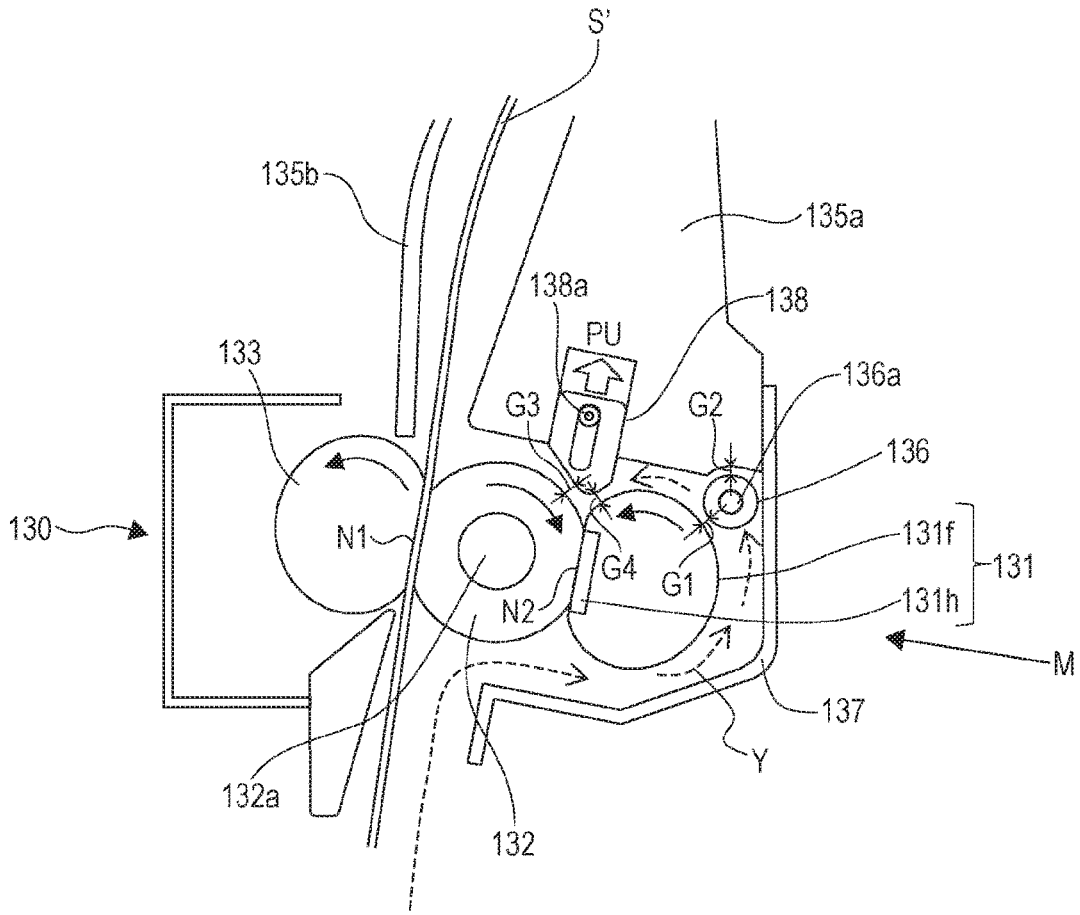
FIG. 7 is a cross-sectional view of a fixing apparatus of a fourth exemplary embodiment.
Figure 8:
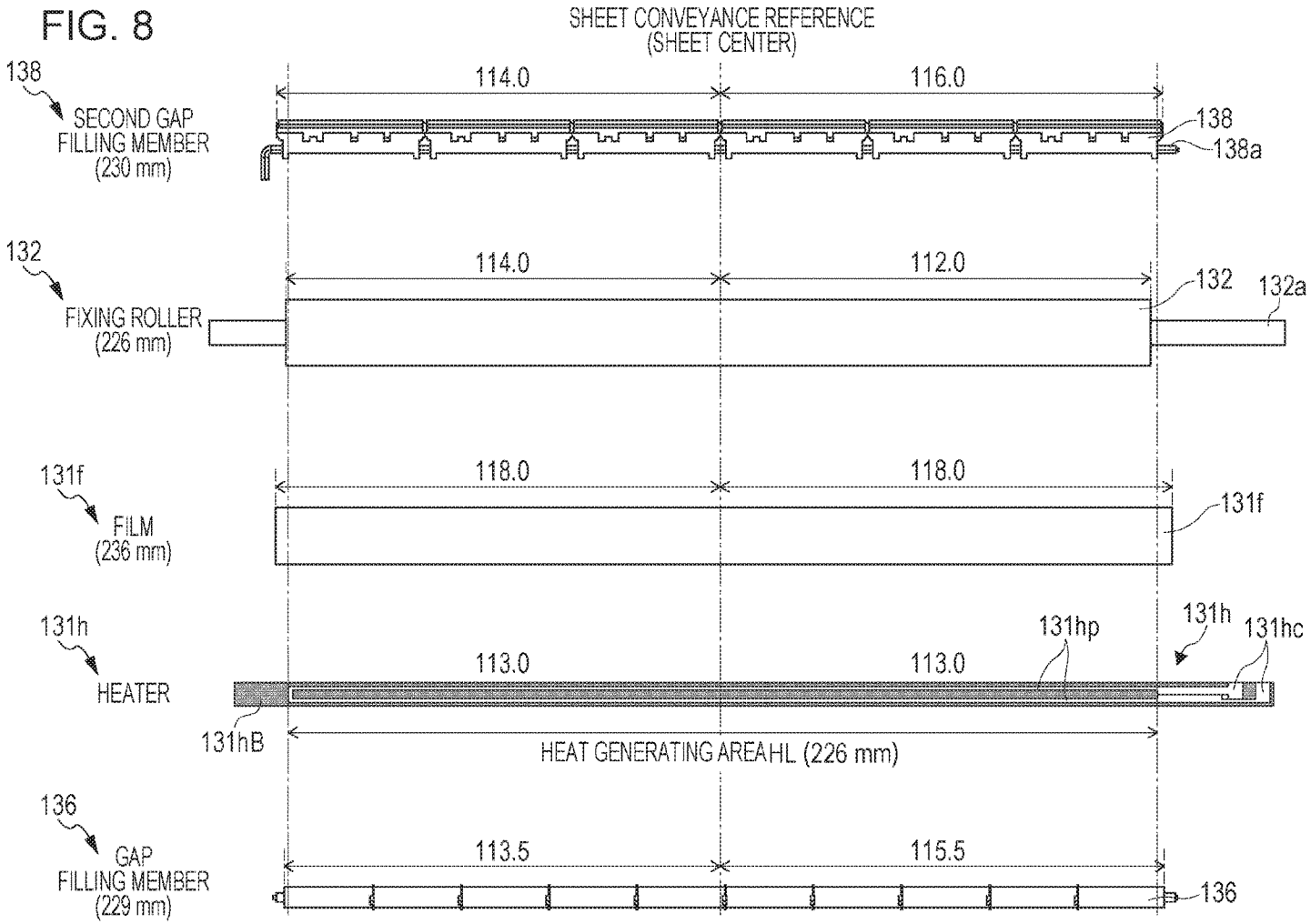
FIG. 8 is a diagram comparing the length of components in the fixing apparatus of the fourth exemplary embodiment in the generatrix direction of a film.

A fourth exemplary embodiment will be described with reference to FIGS. 7 and 8. In addition to the gap filling member 136 illustrated in the third exemplary embodiment, the fixing apparatus according to the present exemplary embodiment includes a second gap filling member (a projection) 138. Note that the second gap filling member 138 is not a rotary member. As illustrated in FIG. 7, the second gap filling member 138 is disposed so as to face the portion (a first position) where the fixing roller 132 and the film 131*f* meet. In other words, the second gap filling member 138 is provided in the guide member 135*a* also serving as the cover member, and protrudes from the guide member 135*a* towards the vicinity of the contact portion between the film 131*f* and the fixing roller 132. The second gap filling member 138 is also divided into a plurality of pieces. As illustrated in FIG. 8, in the present exemplary embodiment, the second gap filling member 138 is divided into 6 pieces. A gap G3 between the fixing roller 132 and the second gap filling member 138 is set to 1.5 mm. Furthermore, a gap G4 between the film 131*f* and the second gap filling member 138 is set to 1.7 mm. A preferable range of the gap G3 is 0.5 mm to 2.0 mm, and a preferable range of the gap G4 is 0.5 mm to 2.0 mm as well. Note that since the second gap filling member 138 is not a rotary member, the gap G4 is desirably set larger than the gap G1. The second gap filling member 138 is held by a shaft 138*a* and the shaft 138*a* is held by a frame (not shown) of the fixing apparatus that holds the guide member 135*a*.

FIG. 8 is a diagram comparing the length of each component of the fixing apparatus in the generatrix direction of the film 131*f*. The heater 131*h* is electrodes 131*hc* for mounting a connector for electric power supply and heat generation members 131*hp*, which are printed on a ceramic substrate 131*h*B. The area in which the heat generation members 131*hp* are provided is 113 mm long in the left and right from a sheet conveyance reference (a sheet center), and a heat generating area HL is 226 mm long. The vaporized component of the wax tends to be generated at a portion in the film 131*f* that has passed through the heat generating area HL of the heater. Accordingly, the gap filling member 136 and the second gap filling member 138 desirably extend across the area exceeding the heat generating area. In the fixing apparatus of the present exemplary embodiment, as illustrated in FIG. 8, the gap filling member 136 is 229 mm long and is provided in an area that is larger than the heat generating area HL.

Furthermore, the second gap filling member 138 is 230 mm long and is provided in an area that is larger than the heat generating area HL.

By disposing the second gap filling member 138, the flow of the upward current Y is restricted in two stages by the gap filling member 136 and the second gap filling member 138 and, accordingly, the flow of the upward current Y can be restricted in a further advantageous manner.

Note that the second gap filling member 138 is capable of moving to the first position that faces the portion where the fixing roller 132 and the film 131*f* meet and to a second position retracted from the first position (a position after being moved in an arrow PU direction in FIG. 7). When installing the fixing apparatus of the present exemplary embodiment, the components, namely, the pressure member 133, the fixing roller 132, and the heating member 131, are installed in this order into the frame of the fixing apparatus in an arrow M direction indicated in FIG. 7. As described above, the second gap filling member 138 is capable of being retracted to the second position, and by retracting the second gap filling member 138 to the second position during the assembling process of the device, it will be possible to avert the components from coming in contact with the second gap filling member 138. With the above, it is possible to prevent the components from becoming damaged by coming in contact with the second gap filling member 138. Note that the second gap filling member 138 is supported by the shaft 138*a* and returns to the first position from the second position by its own weight.

While the first to fourth exemplary embodiments are fixing apparatus that use a film, the gap filling member 136 described above can be employed to a fixing apparatus using, rather than the film, a heat roller with a high rigidity. Since the heat roller is relatively hard, the gap filling member may be fabricated of a soft material such as, for example, silicone rubber.

While the exemplary embodiments of the present disclosure have been described above, the present disclosure is not to be limited by the exemplary embodiments described above, and various other forms may be implemented.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-107880, filed May 27, 2015, which is hereby incorporated by reference herein in its entirety.

What is claimed is:

1. A fixing apparatus that fixes an unfixed toner image formed on a recording material to the recording material, the fixing apparatus comprising:

a rotatable film including a first end face and a second end face opposite the first end face;

a first restriction member that includes a surface that faces the first end face of the film, the first restriction member restricting movement of the film in a generatrix direction of the film in a case where the film is shifted in the generatrix direction and the first end face of the film is in contact with the surface of the first restriction member;

a second restriction member that includes a surface that faces the second end face of the film, the second restriction member restricting movement of the film in a generatrix direction of the film in a case where the film is shifted in the generatrix direction and the second end face of the film is in contact with the surface of the second restriction member;

a pressure member that forms a fixing nip portion that pinches and conveys the recording material by being in contact with the film;

a cover member that surrounds the film;

a cylindrically-shaped rotary member being provided between the film and the cover member such that a gap is formed between the film and the cylindrically-shaped rotary member, wherein a part of the cylindrically-shaped rotary member that is farthest from an axis of rotation of the cylindrically-shaped rotary member is closer to an exit of the fixing nip portion than to an entrance of the fixing nip portion; and a shaft that supports the cylindrically-shaped rotary member, the shaft including a first end attached to the surface of the first restriction member and an opposing second end attached to the surface of the second restriction member such that the cylindrically-shaped rotary member is held by the first and second restriction members, wherein the unfixed toner image formed on the recording material is fixed to the recording material at the fixing nip portion with heat from the film, and wherein a generatrix direction of the cylindrically-shaped rotary member is substantially parallel to a generatrix direction of the film.

2. The fixing apparatus according to claim 1, wherein the gap is in a range of 0.5 mm to 2.0 mm.

3. The fixing apparatus according to claim 2, wherein a region of the gap that is at a middle of the cylindrically-shaped rotary member in the generatrix direction is larger than a region of the gap that is at an end portion of the cylindrically-shaped rotary member in the generatrix direction.

4. The fixing apparatus according to claim 1, wherein a diameter of the cylindrically-shaped rotary member becomes smaller from the middle to the end portion of the cylindrically-shaped rotary member in the generatrix direction.

5. The fixing apparatus according to claim 4, wherein the cylindrically-shaped rotary member is divided into a plurality of pieces in the generatrix direction.

6. The fixing apparatus according to claim 1, wherein a gap between the cylindrically-shaped rotary member and the cover member is in a range of 0.5 mm to 2.0 mm.

7. The fixing apparatus according to claim 1, further comprising:

a heater that heats the film, wherein a length of the cylindrically-shaped rotary member in the generatrix direction is longer than a heat generating area of the heater.

8. A fixing apparatus that fixes an unfixed toner image formed on a recording material to the recording material, the fixing apparatus comprising:

a fixing roller;

a rotatable heat member that is in contact with a surface of the fixing roller, the rotatable heat member including a first end face and a second end face opposite the first end face;

a first restriction member that includes a surface that faces the first end face of the heat member, the first restriction member restricting movement of the heat member in a generatrix direction of the heat member in a case where the heat member is shifted in the generatrix direction and the first end face of the heat member is in contact with the surface of the first restriction member;

a second restriction member that includes a surface that faces the second end face of the heat member, the second restriction member restricting movement of the heat member in a generatrix direction of the heat member in a case where the heat member is shifted in the generatrix direction and the second end face of the heat member is in contact with the surface of the second restriction member;

a pressure member that forms a fixing nip portion that pinches and conveys the recording material by being in contact with the fixing roller;

a cover member that surrounds the fixing roller and the heat member;

a cylindrically-shaped rotary member between the heat member and the cover member, wherein a gap exists between the heat member and the cylindrically-shaped rotary member, wherein the cylindrically-shaped rotary member rotates about an axis of rotation, and wherein the axis of rotation of the cylindrically-shaped rotary member is closer to the heat member than to the cover member; and a shaft that supports the cylindrically-shaped rotary member, the shaft including a first end attached to the surface of the first restriction member and an opposing second end attached to the surface of the second restriction member such that the cylindrically-shaped rotary member is held by the first and second restriction members, wherein the unfixed toner image formed on the recording material is fixed to the recording material at the fixing nip portion with heat from the heat member, and wherein a generatrix direction of the cylindrically-shaped rotary member is substantially parallel to the generatrix direction of the heat member.

9. The fixing apparatus according to claim 8, wherein the heat member is a film.

10. The fixing apparatus according to claim 8, wherein the gap is in a range of 0.5 mm to 2.0 mm.

11. The fixing apparatus according to claim 10, wherein a region of the gap that is at a middle of the cylindrically-shaped rotary member in the generatrix direction is larger than a region of the gap that is at an end portion of the cylindrically-shaped rotary member in the generatrix direction.

12. The fixing apparatus according to claim 8, wherein a diameter of the cylindrically-shaped rotary member becomes smaller from the middle to the end portion of the cylindrically-shaped rotary member in the generatrix direction.

13. The fixing apparatus according to claim 12, wherein the cylindrically-shaped rotary member is divided into a plurality of pieces in the generatrix direction.

14. The fixing apparatus according to claim 8, wherein a gap between the cylindrically-shaped rotary member and the cover member is in a range of 0.5 mm to 2.0 mm.

15. The fixing apparatus according to claim 8, further comprising:

a heater that heats the heat member, wherein a length of the cylindrically-shaped rotary member in the generatrix direction is longer than a heat generating area of the heater.

16. The fixing apparatus according to claim 8, further comprising:

a projection that is provided in the cover member and that protrudes from the cover member towards a vicinity of a contact portion between the heat member and the fixing roller.

17. The fixing apparatus according to claim 16, wherein a gap between the fixing roller and the projection is in a range of 0.5 mm to 2.0 mm.

18. The fixing apparatus according to claim 16, a heater that heats the heat member, wherein a length of the projection in the generatrix direction is longer than a heat generating area of the heater.

19. The fixing apparatus according to claim 1, wherein all of the cylindrically-shaped rotary member is closer to the exit of the fixing nip portion than to the entrance of the fixing nip portion.

20. A fixing apparatus that fixes an unfixed toner image formed on a recording material to the recording material, the fixing apparatus comprising:

a rotatable film including a first end face and a second end face opposite the first end face;

a first restriction member that includes a surface that faces the first end face of the film, the first restriction member restricting movement of the film in a generatrix direction of the film in a case where the film is shifted in the generatrix direction and the first end face of the film is in contact with the surface of the first restriction member;

a second restriction member that includes a surface that faces the second end face of the film, the second restriction member restricting movement of the film in a generatrix direction of the film in a case where the film is shifted in the generatrix direction and the second end face of the film is in contact with the surface of the second restriction member;

a pressure member that forms a fixing nip portion that pinches and conveys the recording material by being in contact with the film;

a cover member that surrounds the film; and a cylindrically-shaped rotary member located between the film and the cover member such that a gap exists between the film and the cylindrically-shaped rotary member, wherein the cylindrically-shaped rotary member is closer to an exit of the fixing nip portion than to an entrance of the fixing nip portion.

* * * * *